United States Patent [19]

Pollak

[11] Patent Number: 4,782,946

[45] Date of Patent: Nov. 8, 1988

[54] SOFT CONTACT LENS HYDRATION DEVICE AND KIT

[75] Inventor: Martin M. Pollak, Laurel Hollow, N.Y.

[73] Assignee: Allergan, Inc., Irvine, Calif.

[21] Appl. No.: 97,868

[22] Filed: Sep. 17, 1987

[51] Int. Cl.[4] ..... A45C 1/04; B65D 85/30

[52] U.S. Cl. ..... 206/223; 206/5.1; 206/523

[58] Field of Search ..... 206/523, 223, 5.1

[56] References Cited

U.S. PATENT DOCUMENTS

| | | | |
|---|---|---|---|
| 3,063,083 | 11/1962 | Obitts | 206/5.1 |
| 3,089,500 | 5/1963 | Stalcup | 206/5.1 |
| 3,115,146 | 12/1963 | Erwin | 206/5.1 X |
| 3,124,240 | 3/1964 | Croan | 206/223 X |
| 3,150,406 | 9/1964 | Obitts | 206/5.1 |
| 3,168,100 | 2/1965 | Rich | 206/5.1 |
| 3,186,540 | 6/1965 | Breger | 206/5.1 X |
| 3,343,657 | 9/1967 | Speshyock | 206/5.1 |
| 3,369,656 | 2/1968 | Skinner, Jr. | 206/5.1 X |
| 3,429,432 | 2/1969 | Cabernoch et al. | 206/223 X |
| 3,645,284 | 2/1972 | Krezanoski et al. | 206/5.1 |
| 4,113,224 | 9/1978 | Clark et al. | 249/10.5 |
| 4,121,896 | 10/1978 | Shepherd | 425/412 |
| 4,294,349 | 10/1981 | Ibsen et al. | 206/523 X |
| 4,337,858 | 7/1982 | Thomas et al. | 206/5.1 |
| 4,369,355 | 1/1983 | Helixon | 219/521 |
| 4,392,569 | 7/1983 | Shoup | 206/5.1 |
| 4,415,076 | 11/1983 | Campbell | 206/5.1 |
| 4,429,786 | 2/1984 | Hucal | 206/5.1 |
| 4,444,307 | 4/1984 | Jermyn | 206/5.1 |
| 4,517,138 | 5/1985 | Rawlings et al. | 264/2.1 |
| 4,517,139 | 5/1985 | Rawlings et al. | 264/2.1 |
| 4,517,140 | 5/1985 | Rawlings | 264/2.1 |
| 4,568,501 | 2/1986 | Wichterle et al. | 264/2.1 |
| 4,568,517 | 2/1986 | Kaspar et al. | 422/30 |
| 4,574,944 | 3/1986 | Gregory | 206/5.1 |

*Primary Examiner*—William Price

*Attorney, Agent, or Firm*—George A. Skoler; Vincent P. Pirri; James Kanagy

[57] ABSTRACT

A hydration device and kit are provided for effecting the hydration of a dehydrated soft contact lens resident within the cavity of a mold element in which the lens was formed.

19 Claims, 2 Drawing Sheets

SOFT CONTACT LENS HYDRATION DEVICE AND KIT

This invention relates to the field of soft contact lenses, i.e., those formed from hydrogels, and receptacles therefor. More particularly, the present invention is directed to a dehydrated contact lens in resident association with the cavity of a mold member in which the lens was formed and a hydration device for the dehydrated lens/mold member combination, optionally provided as part of a kit for hydrating the lens and rendering it suitable for wearing.

The term "hydrogel" is descriptive of any water absorptive, optically clear material which is suitable for the fabrication of a contact lens. Illustrative of such materials are the water swellable, water-insoluble shape-retaining polymers disclosed, inter alia, in U.S. Pat. Nos. 2,976,576, 3,220,960 and 3,822,089. These and related polymers are prepared from liquid polymerizable reaction mixtures containing monomer(s), initiator, catalyst, etc. Upon undergoing polymerization, the mixtures provide sparingly cross-linked water-absorptive polymeric hydrogels. In the hydrated sate, contact lenses formed from such hydrogels are soft and pliable, have high oxygen permeability and as such are relatively comfortable to wear.

Contact lenses can be fabricated employing any of several known and conventional methods. The lenses can be machined, or lathed, to specification from a plastic lens blank. This is a fairly labor- and skill-intensive technique. Soft contact lenses can also be manufactured by various molding techniques which offer obvious advantages of economy. In one method, a plastic lens is cast molded in a static mold (see, for example, U.S. Pat. No. 4,121,896 for a male-female mold assembly which can be used in such a method). In another type of molding method, a plastic lens is formed in a rotating mold (see, for example, the centrifugal lens casting apparatus, molds and procedures described in U.S. Pat. Nos. 4,517,138, 4,517,139, 4,517,140 and 4,568,501).

Whatever the fabrication technique used, the contact lens must undergo one or more post-lens forming operations to prepare it for wearing. Thus, the lens is washed, generally several times, with a hydrating liquid such as physiological saline (0.09 wt. % saline) in order to leach, or extract, any residual unreacted material, e.g., monomer(s), initiator, catalyst, etc., and at the same time swell the lens and render it compatible with the fluids of the eye. Where a lens has been formed by molding, the dehydrated lens, still resident within a mold member used in forming the lens, is introduced into a quantity of hydrating liquid, e.g., physiological saline as just mentioned, which causes the lens to swell and separate from the mold member. Thereafter, the lens is washed, visually inspected, sterilized, packaged, e.g., in a rubber-stoppered glass vial sealed with a metal crimp (usually one of aluminum), and the package is labeled. These post-lens forming operations are carried out at the lens manufacturing site and account for a significant percentage of the cost of a molded contact lens.

In recent years, accumulated medical evidence has strongly pointed to the considerable benefits to eye health to be gained by replacing contact lenses on a fairly frequent and regular basis. Lens care regimens involving surfactants and/or enzymatic protein removal procedures are at best only moderately successful in maintaining lenses in an optimum state of cleanliness. Even this degree of lens maintenance becomes greatly compromised when the wearer fails to adhere to the proper regimen.

Dirty lenses contribute to visual and physiological problems. This is especially true with extended wear lenses because wearers often are unaware of a problem with a dirty lens and may continue to wear a lens despite its having accumulated excessive dirt and proteinaceous debris.

Considerations of economy aside, the ideal answer to this problem would be to provide the contact lens wearer with the capability for disposing the lenses on a frequent scheduled basis and replacing them with new, clean factory fresh lenses. This approach has already been promoted in various forms by contact lens suppliers. Thus, in one case, patients are dispensed several sets of lens in conventional sterile glass vials, such as those described above, which are normally used to store and ship lenses to practitioners. The high cost of the post-lens forming operations previously referred to tends to make such frequent replacement of lenses prohibitively expensive thereby discouraging the implementation of what is otherwise a sound and beneficial opthalmic practice.

U.S. Pat. No. 4,429,786 describes an integrated contact lens maintenance kit and carrying apparatus for the storage and carrying of a user's contact lenses as well as a plurality of liquids normally utilized with such lenses. U.S. Pat. No. 4,568,517 describes a kit for disinfecting lenses with a hydrogen peroxide solution and for neutralizing the hydrogen peroxide solution. The kit comprises means for washing the lens and a tablet or particulate neutralizer. No mention is made in either of these patents of hydrating a molded dehydrated soft contact lens resident within the cavity of a mold element or of separating the lens from the mold.

It is an object of the present invention to provide a device for facilitating the hydration of a molded soft contact lens resident in the cavity of a mold element in which the lens was formed, the separation of the lens from the mold and, optionally, one or more additional post-lens forming treatments such as extraction of residual material(s), disinfection, cleaning, and the like.

Another object of the invention is to provide a disposable kit for effecting hydration of a dehydrated molded soft contact lens residing within the cavity of a mold element in which the lens was formed, the kit being primarily intended for use away from the site at which the lens is manufactured.

It is a particular object of the invention to provide such a disposable kit together with a quantity of combined dehydrated lens/mold elements and hydration devices and, optionally, one or more other components useful in such other post-lens forming treatments as previously mentioned.

SUMMARY OF THE INVENTION

By way of satisfying these and other objects of the invention, there is provided a lens hydration device possessing an enclosure containing at least one dehydrated contact lens in resident association with the cavity of a mold element in which the lens was formed, said hydration device possessing means for permitting contact of the lens with hydration liquid.

The invention further comprises a kit for effecting the hydration of a dehydrated contact lens and the separation of the lens from the cavity of a mold element in which the lens was formed, the kit comprising:

(a) at least one lens hydration device possessing an enclosure capable of containing at least one dehydrated contact lens in resident association with the cavity of a mold element in which the lens was formed, said device possessing means for permitting contact of said lens with hydration liquid;

(b) at least one dehydrated contact lens in resident association with the cavity of a mold element in which the lens was formed; and, (c) a quantity of hydration liquid.

Use of the lens hydration device and kit of this invention makes it possible to shift the hydration and demolding operations and, optionally, other post-lens forming operations, procedures which contribute appreciably to the cost of factory-finished lenses, from the lens manufacturing site to the contact lens wearer. Thus, in avoiding the cost of factory labor associated with some or all of such post-lens forming operations as hydrating the lens out of the mold, washing the hydrated lens, sterilizing the lens, packaging the lens in the sort of bulky glass vials typically used for this purpose and labeling the lens package, the foregoing lens hydration device and kit make it economically feasible for a contact lens wearer to discard worn lenses on a regular and frequent basis.

DESCRIPTION OF THE PREFERRED EMBODIMENTS

As indicated above, the present invention contemplates a dehydration device and kit for carrying out hydration and, optionally, other post-lens forming operations upon a molded soft contact lens. Illustrative of such lenses are those formed from a lens-forming reaction mixture containing hydrophilic monomers, e.g., those which form slightly or moderately crosslinked, three dimensional networks as disclosed in aforesaid U.S. Pat. Nos. 2,976,576, 3,220,960 and 3,822,089. These materials upon undergoing polymerization provide "sparingly" cross-linked, water-absorptive shape- retaining articles such as contact lenses of 2-hydroxyethyl methacrylate polymers. The invention contemplates lenses manufactured from these and any other kinds of water-swellable materials.

Following lens formation employing either of the molding procedures referred to above, the dehydrated lens is hydrated (which also causes the lens to separate from the mold element) and any unreacted monomer(s) and/or other extraneous material(s) are removed therefrom.

Figure 1:
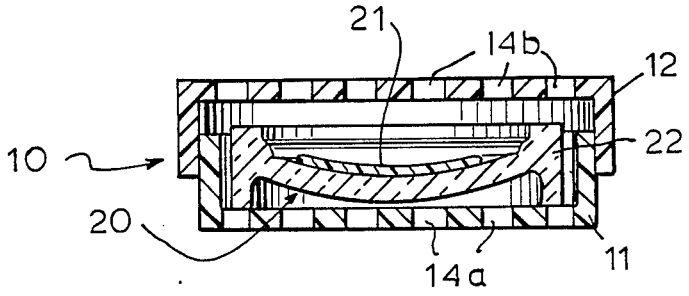
FIG. 1 illustrates in enlarged cross-section, a lens hydration device containing a dehydrated soft contact lens within the cavity of a mold element in which the lens was formed.
Figure 2:
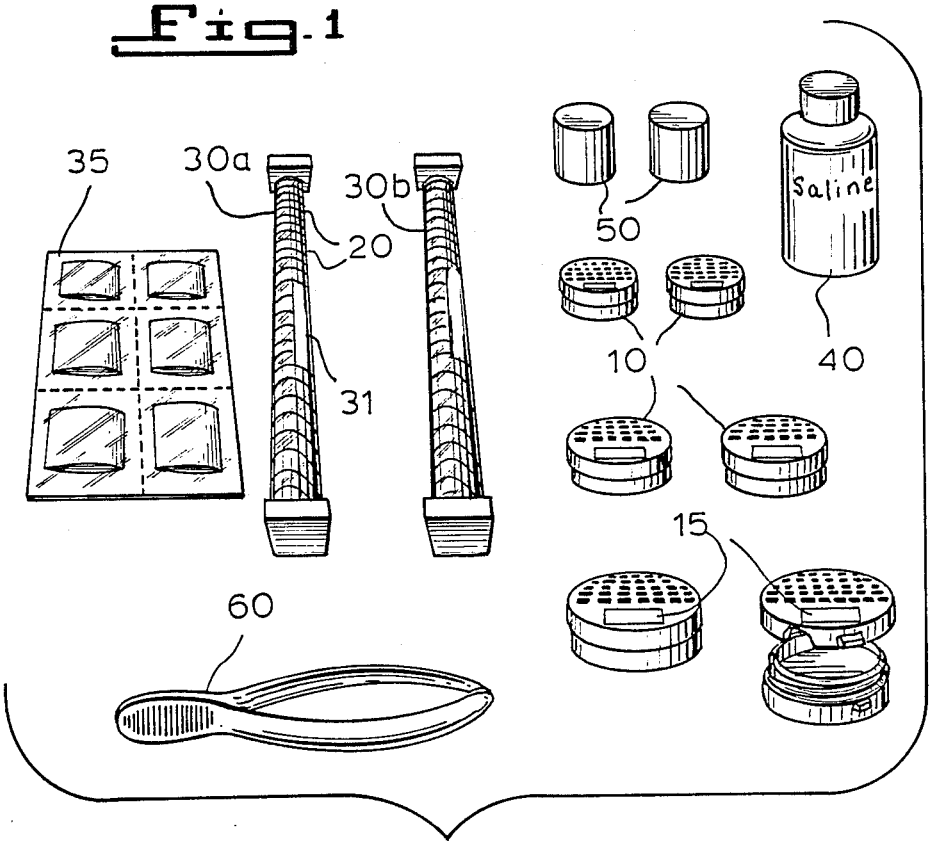
FIG. 2 illustrates the various components of one embodiment of a dehydrated soft contact lens treatment kit in accordance with this invention; and, FIG. 3 illustrates a convenient package arrangement for storing the various components of a dehydrated soft contact lens treatment kit shown in FIG. 2.

Referring, now, to FIG. 1, hydration device 10 includes lower and upper members 11 and 12, respectively, which cooperate to form an enclosure 13 of dimensions sufficient to accommodate at least one dehydrated contact lens/mold element combination 20. Members 11 and 12 can be clear or opaque, hinged or non-hinged, i.e., detachable, and can be provided with any suitable means to effect their interengagement, e.g., threading, a snap-lock, friction fitting (as shown), etc. Perforations **14*a* and 14*b* defined within lower and upper members 11 and 12, respectively, permit passage of hydration liquid, e.g., physiological saline, into and through enclosure 13. As shown in FIG. 2, a portion 15 of upper member 12 can be texturized to facilitate labelling with a pencil or indelible ink so as to identify the combined contact lens/mold element assembly 20** enclosed in the hydration device.

While members 11 and 12 can be fabricated from a wide variety of materials, they are preferably manufactured by injection molding a thermoplastic resin such as polyethylene, polypropylene, polycarbonate, polyester, polyamide, etc. The upper and lower members of the hydration device can, if desired, be molded as a single unit joined through a flexible hinge.

Enclosure 13 of hydration device 10 is occupied by dehydrated contact lens 21 resident in the cavity of mold element 22. Combined dehydrated lens/mold element assembly 20 can be provided as a separate unit or, as illustrated, it can be provided already present within the enclosure of hydration device 10.

In a preferred embodiment of the present invention, a quantity of hydration devices 10 and combined dehydrated contact lens/mold element assemblies 20 are provided in kit form together with a quantity of hydration liquid and, if desired, one or more other lens treating materials such as disinfectant, sterilizer, cleaner, preservative, and the like. The individual components of one such kit are shown in FIG. 2 and include a quantity of combined dehydrated contact lens/mold element assemblies 20 which can be provided in stoppered tubular containers **30*a* and 30*b* suitably labeled to indicate the diopters of the lens and/or other lens identifying indicia. Alternatively, the combined dehydrated contact lens/mold element assemblies can be packaged in individually separable and labeled bubble packets formed as part of a perforate sheet 35 or strip. Yet another alternative is to provide combined lens/mold assemblies 20 already contained within labelled hydration device 10. The kit further includes a quantity of hydration liquid 40**, e.g., physiological saline, which may or may not be concentrated and which may or may not contain a buffering agent and/or other optional ingredient(s).

Optional components of the kit can include one or more vessels 50, preferably of flame-proof or fire-resistant glass, for holding hydration fluid and/or other liquid(s), soft-tipped tweezers 60 for holding the contact lenses and one or more lens treatment materials, liquid or otherwise. Thus, e.g., the kit of this invention can include, besides hydration liquid, one or more soft contact lens cleaning, disinfectant, sterilizing, preserving, storing and/or peroxide removal compositions. Examples of such optional compositions include the oxygen-releasing salt-containing isotonic lens cleaning and sterilizing solutions of U.S. Pat. No. 3,873,696; the nonionic surfactant-containing lens cleaning and storing compositions of U.S. Pat. No. 3,882,036; the hydrogen peroxide decomposition catalysts of U.S. Pat. No. 3,912,451; the quaternary ammonium compound-containing lens sterilizing compositions of U.S. Pat. No. 4,029,817; the polyoxyethylene-polyoxypropylene block copolymer-containing cold disinfectant solutions of U.S. Pat. No. 4,356,100; the dimethyldiallylammonium chloride homopolymer-containing lens disinfectant compositions of U.S. Pat. Nos. 4,367,548 and 4,443,429; the amphoteric surfactant, non-ionic surfactant and chlorhexidine-containing (and, optionally, thimerosal-containing) lens disinfecting and/or preserving solutions of U.S. Pat. No. 4,354,952; the ascorbic acid-containing ambient temperature lens disinfectant compositions of U.S. Pat. No. 4,367,157; the pentanedial-containing and, optionally, thimerosal-containing, lens disinfecting and preserving solutions of U.S. Pat. Nos. 4,381,314 and 4,444,784; the lens cleaning solutions based on peroxide, transition metal salts, amphoteric or anionic surfactants described in U.S. Pat. No. 4,414,127; the ascorbic acid and potentiating compound (e.g., trimethoprim or thimerosal)-containing ambient temperature lens disinfectant solutions of U.S. Pat. No. 4,401,582; the $C_{5-12}$ fatty acid-containing disinfecting solutions of U.S. Pat. No. 4,410,442; the mixture of surfactants employed as lens cleaning compositions as described in U.S. Pat. No. 4,440,662; the glycerol monolaurate and antimicrobial agent-containing lens disinfecting compositions of U.S. Pat. No. 4,485,029; the contact lens preserving solutions containing an ene-diol compound, e.g., ascorbic acid or dihydroxymaleic acid, and a source of copper ion as disclosed in U.S. Pat. No. 4,490,389; the mixture of anionic and nonionic surfactants, said to exhibit a synergistic lens cleaning effect, described in U.S. Pat. No. 4,500,441; the nonionic surfactant and chlorhexidine salt-containing lens cleaning solutions of U.S. Pat. No. 4,504,405; the trimethoprim-containing lens preservative compositions of U.S. Pat. Nos. 4,510,065, 4,529,535, 4,543,200 and 4,560,491 which additionally contain other ingredients such as EDTA, benzyl alcohol and adjuvant bactericides, e.g., sorbic acid or ascorbic acid; the lens disinfecting and sterilizing compositions containing hydrogen peroxide, surfactant and aqueous alcoholic mixture of a tertiary amine and a fatty acid alkanolamide as described in U.S. Pat. Nos. 4,518,585 and 4,557,898; the sodium pyruvate-containing solutions (for decomposing a hydrogen peroxide lens sterilizing solution) disclosed in U.S. Pat. No. 4,521,375; the biguanide-containing lens disinfecting and/or preserving solutions of U.S. Pat. No. 4,537,746; a neutralizer such as sodium sulfite or sodium thiosulfate, and optionally, buffering agents, for addition to an aqueous hydrogen peroxide lens disinfectant solution to convert the latter into a saline lens storage solution as described in U.S. Pat. No. 4,568,517; a catalyst such as catalase for addition to a hydrogen peroxide lens disinfecting solution to decompose the latter following the disinfection procedure; and, the peroxidase-oontaining lens disinfecting system of U.S. Pat. No. 4,588,586, the disclosures of which are incorporated by reference herein.

Figure 3:
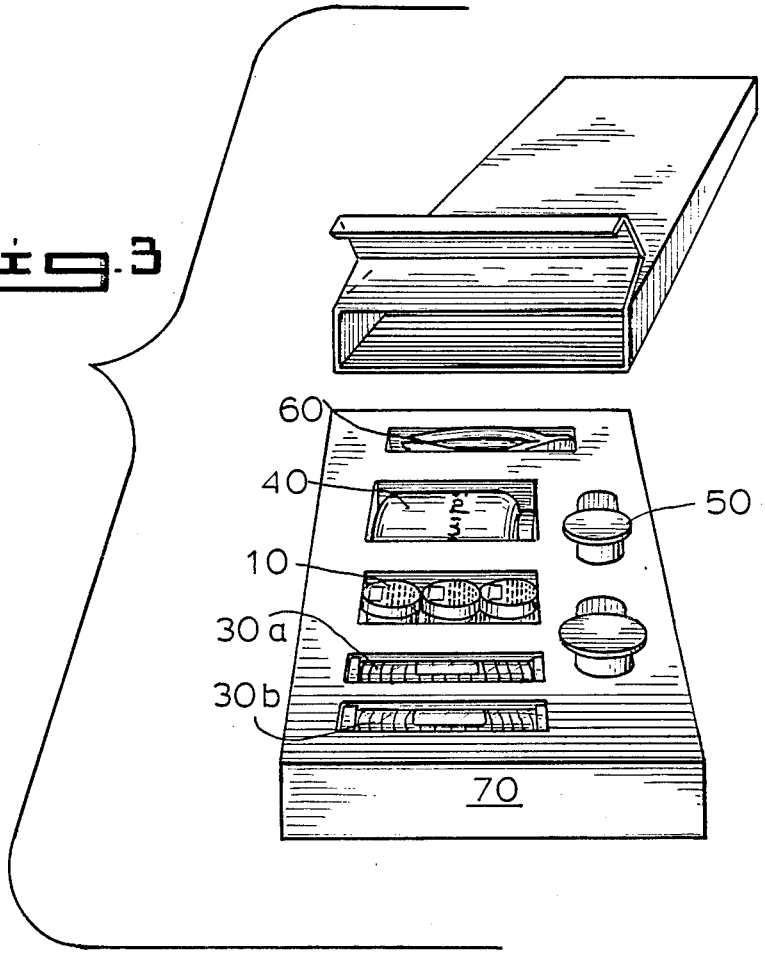

The necessary as well as some optional components of the contact lens kit herein are shown in FIG. 3 assembled in a oonvenient packaging unit 70 containing recesses for each component. Thus, each of the kit components shown in FIG. 1 is shown occupying a suitably dimensioned recess in packaging unit 70, e.g., fabricated from an impact-absorbing material such as a polyolefin foam or styrenic resin foam, which can be snugly fitted within an exterior paper carton for shipment and/or storage.

The principal operations involving the components of the dehydrated contact lens treatment kit of FIGS. 2 and 3 are hydration and extraction. In the first of these operations, the combined dehydrated soft contact lens/-mold element assembly 20 is enclosed within enclosure 13 of hydration device 10 with upper member 12 thereof being suitably marked with pencil or indelible ink to identify the lens within. The device is then immersed in boiling water or physiological saline for 3-5 minutes or so to hydrate lens 21 and release it from mold element 22. Following removal of the hydration device from the boiling liquid, the mold and lens are removed therefrom, preferably with soft-tipped tweezers 60. The mold element is discarded and the lens is returned to cavity 13 of hydration device 10 for the extraction procedure. In the latter operation, water or saline 40 is heated to 60 ±10°C. and the hydration device with its hydrated lens is immersed therein for four hours. Thereafter, the lens is placed in vessel 50 containing a small quantity of saline 40 for about one hour. The hydrated, extracted lens may thereafter be washed, sterilized, etc., prior to being worn.

Although illustrative embodiments of the present invention have been described herein with reference to the accompanying drawings, it is to be understood that the invention is not limited to these precise embodiments, and that various other changes and modifications may be effected therein by one skilled in the art without departing from the scope or spirit of the invention.

What is claimed is:

1. A hydration device comprising an enclosure possessing means for permitting contact of a dehydrated contact lens in resident association with a mold element in which the lens was formed with hydration liquid, said device containing at least one such combined lens/mold element assembly.

2. The hydration device of claim 1 wherein the enclosure is defined by upper and lower interengaging members either or both of which possess one or more passages for admitting hydration liquid therein.

3. The hydration device of claim 1 wherein the dehydrated contact lens is resident within the cavity of a mold element employed in a centrifugal lens casting procedure.

4. A kit for effecting the hydration of a dehydrated contact lens and the separation of the lens from the cavity of a mold element in which the lens was formed which comprises:

(a) at least one lens hydration device possessing an enclosure capable of containing at least one dehydrated contact lens in resident association with the cavity of a mold element in which the lens was formed, said device possessing means for permitting contact of said lens with hydration liquid;

(b) at least one dehydrated contact lens in resident association with the cavity of a mold element in which the lens was formed; and, (c) a quantity of hydration liquid.

5. The kit of claim 4 wherein the dehydrated contact lens is resident within the cavity of a mold element employed in a centrifugal lens casting procedure.

6. The kit of claim 4 wherein the enclosure of the hydration device is defined by upper and lower interengaging members either or both of which possess one or more passages for admitting hydration liquid therein.

7. The kit of claim 4 wherein a plurality of such combined dehydrated lens/mold element assemblies and hydration devices are provided.

8. The kit of claim 7 wherein the combined dehydrated lens/mold element assemblies are stored within a tubular container.

9. The kit of claim 7 wherein one or more combined dehydrated lens/mold element assemblies are packaged in a packet.

10. The kit of claim 7 wherein one or more combined dehydrated lens/mold element assemblies are packaged in individually separable packets formed as part of a sheet or strip of said packets.

11. The kit of claim 7 wherein at least a portion of an exterior surface of the hydration devices is capable of receiving lens-identifying indicia applied thereto.

12. The kit of claim 4 further comprising one or more vessels for holding hydration liquid and/or other lens treating composition(s).

13. The kit of claim 4 further comprising means for gripping the contact lens.

14. The kit of claim 13 wherein the gripping means is a set of soft-tipped tweezers.

15. The kit of claim 4 comprising at least one additional material or composition for treating the contact lens.

16. The kit of claim 15 wherein said additional material or composition is one for cleaning, sterilizing, preserving, storing, removing peroxide, or performing any combination of the aforesaid operations.

17. The kit of claim 4 further comprising a packaging unit for receiving the kit components.

18. The kit of claim 17 wherein the packaging unit is an impact-absorbing material or construction containing recesses for the kit components.

19. The kit of claim 18 wherein the impact-absorbing material is a polyolefin foam or a styrenic polymer foam.

* * * * *